US011008715B2

(12) United States Patent
Risi

(10) Patent No.: US 11,008,715 B2
(45) Date of Patent: May 18, 2021

(54) EQUIPMENT FOR MACHINING SURFACES, IN PARTICULAR SOLID SURFACES, IN PARTICULAR FOR MACHINING RUMBLE STRIPS

(71) Applicant: SIMEX ENGINEERING S.R.L., Bologna (IT)

(72) Inventor: Mirco Risi, Bologna (IT)

(73) Assignee: SIMEX ENGINEERING S.R.L., Bologna (IT)

( * ) Notice: Subject to any disclaimer, the term of this patent is extended or adjusted under 35 U.S.C. 154(b) by 0 days.

(21) Appl. No.: 16/463,863

(22) PCT Filed: Nov. 24, 2017

(86) PCT No.: PCT/IB2017/057380
§ 371 (c)(1),
(2) Date: May 24, 2019

(87) PCT Pub. No.: WO2018/096494
PCT Pub. Date: May 31, 2018

(65) Prior Publication Data

US 2020/0141071 A1 May 7, 2020

(30) Foreign Application Priority Data

Nov. 24, 2016 (IT) ..... 2016119002

(51) Int. Cl.
*E01C 23/088* (2006.01)
*B28D 1/18* (2006.01)
(Continued)

(52) U.S. Cl.
CPC ..... *E01C 23/088* (2013.01); *B28D 1/18* (2013.01); *E01C 23/0993* (2013.01); *E01C 23/127* (2013.01)

(58) Field of Classification Search
CPC ..... E01C 23/088; E01C 23/12; E01C 23/09
(Continued)

(56) References Cited

U.S. PATENT DOCUMENTS 5,297,894 A * 3/1994 Yenick ..... E01C 23/0946 299/1.5
5,484,228 A 1/1996 Thomas et al.
(Continued)

FOREIGN PATENT DOCUMENTS

DE 8911435 U1 11/1989
EP 1197601 A2 4/2004
(Continued)

OTHER PUBLICATIONS

KR 2016002970 U, Korea, 3 pages (Year: 2016).*
KR 1639169 B1, Korea, 4 pages (Year: 2016).*

*Primary Examiner* — Sunil Singh
(74) *Attorney, Agent, or Firm* — Arent Fox LLP; Michael Fainberg

(57) ABSTRACT

Equipment for machining solid surfaces such as for example, surfaces made of asphalt or concrete or similar solid materials, in particular for making sound strips, said equipment comprising rotating machining or digging means carried by a main frame, and rotating means which engage said main supporting frame, wherein the rotation of said rotating means in a predefined direction of rotation results in said main supporting frame being rotated alternately in two opposite directions of rotation.

15 Claims, 9 Drawing Sheets

(51) Int. Cl.
*E01C 23/09* (2006.01)
*E01C 23/12* (2006.01)

(58) Field of Classification Search
USPC ..... 299/39.1, 39.4, 39.6; 404/93, 94
See application file for complete search history.

(56) References Cited

U.S. PATENT DOCUMENTS

| | | | | |
|---|---|---|---|---|
| 6,623,083 | B1 * | 9/2003 | Risi | E01C 23/088 299/39.4 |
| 8,002,360 | B2 * | 8/2011 | Cochran | E02F 3/20 299/39.6 |
| 2002/0110420 | A1 | 8/2002 | Murphy | |
| 2004/0166774 | A1 | 8/2004 | Cochran et al. | |

FOREIGN PATENT DOCUMENTS

| | | | |
|---|---|---|---|
| EP | 2495367 | A1 | 9/2012 |
| WO | 2016038126 | A1 | 3/2016 |

* cited by examiner

EQUIPMENT FOR MACHINING SURFACES, IN PARTICULAR SOLID SURFACES, IN PARTICULAR FOR MACHINING RUMBLE STRIPS

CROSS-REFERENCE TO RELATED APPLICATIONS

This application is the U.S. National Stage Application of International Patent Application No. PCT/IB2017/057380, filed on Nov. 24, 2017, which claims priority to Italian Patent Application No. 102016000119002, filed on Nov. 24, 2016, the contents of each of which is incorporated herein by reference in its entirety.

TECHNICAL FIELD OF THE PRESENT INVENTION

The present invention relates to the machining of surfaces, in particular of solid floors such as for example, floors made of concrete, asphalt or similar solid materials. The present invention in particular relates to an equipment for making sound strips in surfaces and/or floors of the aforesaid type. In detail, the present invention relates to an equipment of the aforesaid type which allows making said sound strips by means of rotating milling means, moreover wherein the equipment allows executing normal milling operations at substantially constant and adjustable depth according to needs and/or circumstances.

BACKGROUND ART

The definition "sound strips" commonly identifies the irregularities intentionally obtained on the road surfaces in order to generate a sudden change of the guiding perception by the driver of a vehicle, for example a motor vehicle but also a motorcycle or also a heavy-duty vehicle (trucks or the like). Practically, these are depressions (usually transverse to the driving lane and therefore to the driving direction of the vehicles) obtained by the surface "scarifying" of the road surface at substantially regular intervals, and that is by removing portions of the road surface. FIG. 7 (at the bottom) shows an example of sound strips, in the specific case, of transverse depressions with maximum depth of 1.3 cm (with respect to the paved surface) and made at a regular distance from one another (in the driving direction) of about 30 cm; practically, when involved by the wheels of a vehicle, the strips cause vibrations in the vehicle, therefore wherein the noise generated by the vibrations (and possibly the vibrations themselves) generate the aforesaid sudden change of the driving perception of the driver, which in many cases is useful in avoiding going off the road but also unintentional lane changes due to sleepiness and/or fatigue.

The creation of sound strips therefore is an increasingly favored solution within the framework of measures for improving road and driving safety, wherein for this purpose the sound strips (commonly known also as "rumble strips") preferably are made in particularly critical points such as for example, between the driving and emergency lane, but also close to toll booths and/or intersections and roundabouts (in the case of rural roads not belonging to the motorway network) in order to generate an alert by taking advantage of the combined effect of the vibrations and the noise.

It is also to be considered that the sound strips of the aforesaid type are an effective, long-lasting solution (but at the same time with substantially contained costs, in particular with respect for example, to the adhesive ones made by means of depositing elastoplastic rolled sections), wherein also the maintenance costs may be effectively contained.

Currently, making sound strips of the aforesaid type (depressions) is performed by means of dedicated equipment and/or machines and therefore, designed and made for this purpose. However, although the equipments of known type can be appreciated from different points of view, same are affected by several different drawbacks.

As indicated above, a first drawback relates to the poor versatility of the equipments of known type which, being dedicated only to (and usable exclusively for) making sound strips, often results in unaffordable amortization costs, especially for small-to-medium companies.

Moreover, in addition to resulting in significant costs (both purchase and maintenance and/or management costs), the equipments of known type have significant volumes and sizes with subsequent, just as significant logistic problems associated in particular with transport and storage. Moreover, it must not be overlooked that cumbersome equipments require opening a yard having sizes related to the volume of the machines and/or apparatuses, with serious repercussions on roads.

And again, the problem of poor versatility is particularly felt also in the case of equipments with more reduced volumes, wherein here the possibility of using the apparatuses for different purposes (for example, for normal scarifying and/or milling) is precluded by the limited performance, for example in terms of power, of the equipment and/or machines themselves.

It is therefore the main object of the present invention to overcome or at least minimize the drawbacks encountered in the equipments according to the prior art. In particular, it is an object of the present invention to overcome the above-described drawbacks of the equipments according to the prior art. In detail, it is a further object of the present invention to provide an equipment of the aforesaid type which can be used for different objects and purposes, in particular both for making sound strips and for the normal scarifying and/or milling operations of floors and/or solid surfaces, for example, made of asphalt and/or concrete.

Again, it is a further object of the present invention to provide an equipment which in addition to ensuring the desired versatility (not ensured by apparatuses of known type), is characterized by contained costs and/or volumes and which is also adapted to be applied to (and therefore operated by means of) different types of machines having reduced sizes and contained costs (both purchase and management and/or maintenance costs), such as for example, "skid steer loaders" and/or "small wheel loaders".

In view of the objects summarized above, the present invention is based on the general consideration according to which the same objects may be reached by applying a removable carriage or kit to a milling machine substantially of known type, which when applied to the milling machine, causes alternate downwards and upwards oscillations in the milling machine itself so that the milling member engages the surface to be machined alternately and/or at various depths.

It is therefore apparent from what summarized above that the dual functionality of the equipment is ensured by the possibility of removing the carriage or kit, wherein by removing the carriage or kit, the equipment lends itself to being used for different operations such as normal milling.

Moreover, the use of the removable carriage allows the setting of the equipment according to the purpose by means of simple and immediate operations, and therefore with contained costs.

DESCRIPTION OF THE PRESENT INVENTION

On the basis of the considerations disclosed above and in consideration of the problems and/or drawbacks encountered in equipments of known type, in particular equipments having both large and small sizes, according to a first embodiment, the present invention provides an equipment for machining solid surfaces or floors such as surfaces made of asphalt or concrete or similar solid materials, in particular for milling and/or scarifying said solid surfaces or floors, said equipment comprising coupling means for mechanically coupling said equipment to a main operating machine, a main supporting frame and rotatable machining or milling means carried by said main supporting frame and adapted to be rotated about a first predefined rotation axis; wherein said main supporting frame is fixed to said coupling means so as to be rotatable about a second rotation axis substantially parallel to said first rotation axis; wherein said equipment comprises an adjusting carriage for adjusting the working depth of said machining or milling means; and wherein said adjusting carriage comprises rotating means which engage said main supporting frame, the rotation of said rotating means in a predefined direction of rotation resulting in said main supporting frame being rotated about said second rotation axis alternately in two opposite directions of rotation with respect both to said coupling means and to said adjusting carriage.

According to one embodiment, said rotating means of said adjusting carriage comprise at least one cam element which defines a cam surface by means of which said cam element engages said supporting frame.

According to one embodiment, said cam element comprises a predefined number n of lobes, whereby a complete rotation of said cam element results in n rotations of said supporting frame about said second rotation axis in the same direction of rotation.

According to one embodiment, said at least one cam element is rotatable about a third rotation axis substantially parallel to said first and second rotation axes.

According to one embodiment, said adjusting carriage comprises a supporting structure structured so as to define an internal space in which said supporting frame is at least partially housed.

According to one embodiment, said adjusting carriage comprises drawing means for drawing in rotation said rotation means.

According to one embodiment, said drawing means comprise at least one wheel adapted to be drawn in rotation through contact with the surface to be machined, wherein said adjusting carriage comprises transmission means for transmitting the rotating motion from said at least one wheel to said rotation means.

According to one embodiment, said transmission means are of the type comprising a chain.

According to one embodiment, said adjusting carriage is removably fixed to said coupling means.

According to one embodiment, said supporting frame and said machining means are structured in such a manner whereby the removal of said adjusting carriage allows normal milling operations to be performed at a substantially constant and adjustable depth.

According to one embodiment, said equipment comprises an adjusting frame which defines at least one substantially flat contact portion adapted to be arranged in contact with a corresponding portion of the surface to be machined; and adjustment means adapted to allow adjusting the position of said adjusting frame with respect to said main supporting frame so as to allow adjusting the working depth of said machining means.

According to one embodiment, said adjustment means comprise a first fixing arm or lever adapted to be rotated with respect to said main supporting frame and by means of which said adjusting frame is fixed to said main frame, so that rotating said fixing arm about its rotation axis in two opposite directions of rotation results in said adjusting frame being translated with respect to said main supporting frame respectively in two opposite directions of translation.

According to one embodiment, said fixing arm is structured as a class 1 lever, wherein said adjusting frame is rotatingly fixed to a first end portion of said fixing arm which comprises the point of application of the resistance of said lever.

According to one embodiment, said adjustment means comprise alternately extensible and retractable operating means applied to said second end portion of said fixing arm so that the extension of said operating means results in said arm being rotated in one direction of rotation while the retraction of said operating means results in said arm being rotated in the opposite direction of rotation.

According to one embodiment, said adjusting frame and said adjustment means are removably applied to said supporting frame in replacement of said adjusting carriage.

The present invention further relates to a machine for machining solid surfaces such as asphalt or concrete or made of similar solid materials, in particular for making sound strips in said solid surfaces, and milling said surfaces, said machine being equipped with an equipment according to any one of the embodiments summarized above.

Further embodiments of the equipment and of the machine according to the present invention are defined in the dependent claims.

BRIEF DESCRIPTION OF THE DRAWINGS

The present invention is clarified below by means of the description of some embodiments thereof as depicted in the accompanying drawings. It is to be noted that the present invention in any case is not limited to the embodiments depicted in the drawings and described below; contrarily, all those variants or modifications of the embodiments depicted and described below, which are clear, obvious and apparent to persons skilled in the art, fall within the scope or are the object of the present invention. In particular, in the accompanying drawings.

DETAILED DESCRIPTION OF THE PRESENT INVENTION

The present invention particularly and effectively applies in the case of equipment for milling solid surfaces and/or floors; this therefore is the reason why the present invention is described below with particular reference to the application thereof in the case of milling equipments for milling or milling machine.

The possible applications of the present invention in any case are not limited to the case of milling equipments; contrarily, the present invention is effectively and conveniently applied in various equipments such as for example, pit and/or trench digging equipments or in any case, for machining and/or demolishing surfaces, in particular solid surfaces.

As indicated above, two arrangements are possible in case of the equipment according to the present invention, each provided for at least one possible use of the equipment.

Figure 1:
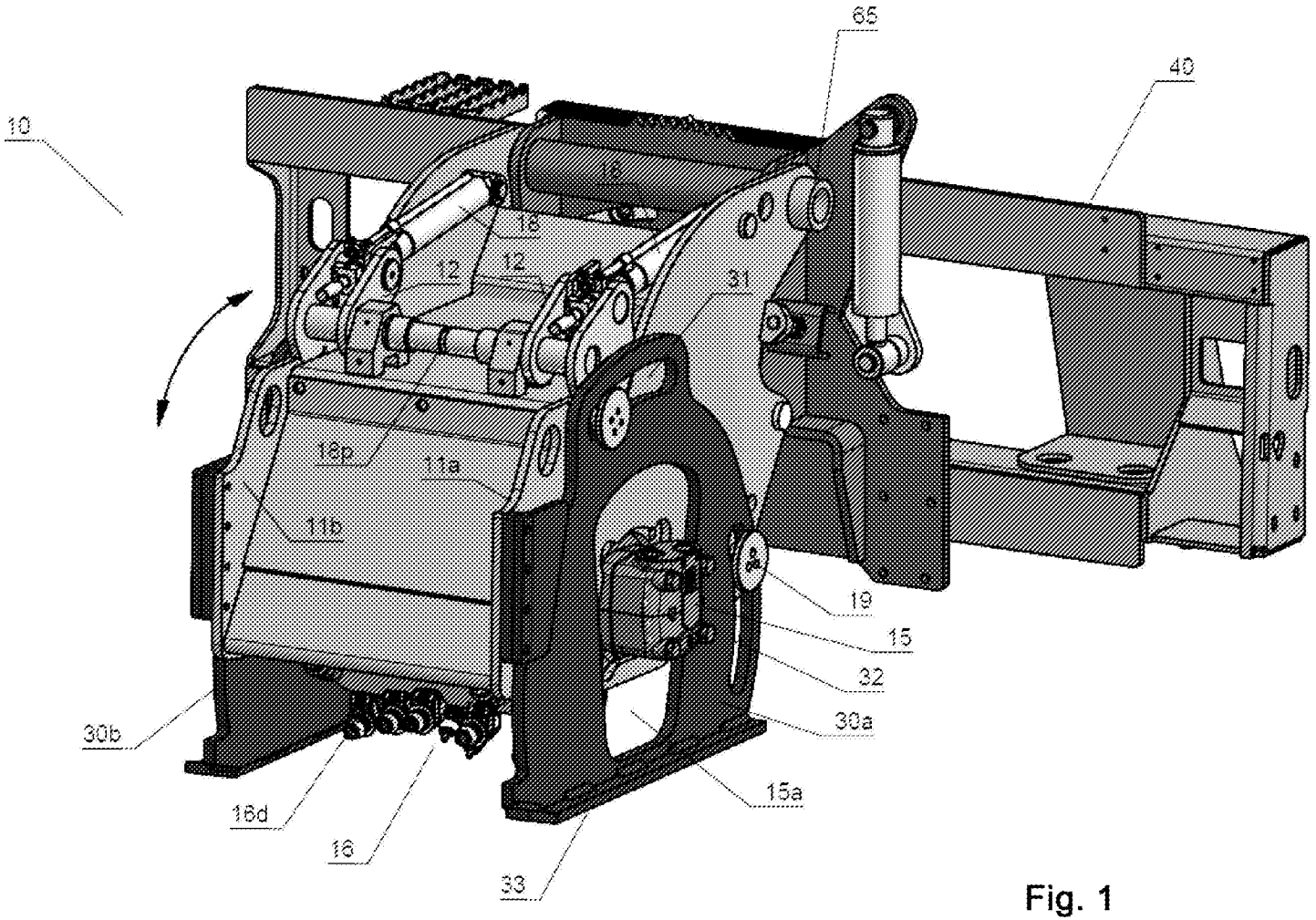
FIG. 1 shows a side view of an equipment according to one embodiment of the present invention, in a first arrangement.
Figure 2:
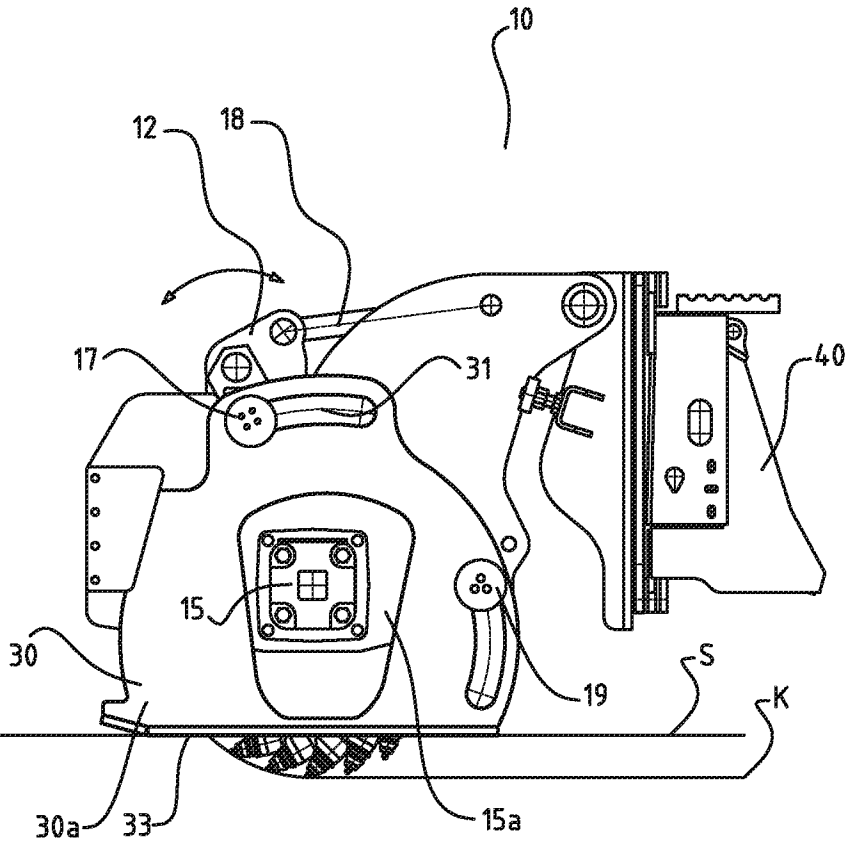
FIG. 2 shows a perspective view of an equipment according to one embodiment of the present invention, in a first arrangement.

A first use relates to milling solid surfaces at a predefined, substantially constant depth which can be preset as liked and/or according to needs and/or circumstances; the arrangement depicted in FIGS. 1 and 2 is provided for said first use, in which the equipment is identified by reference numeral 10.

Figure 6B:
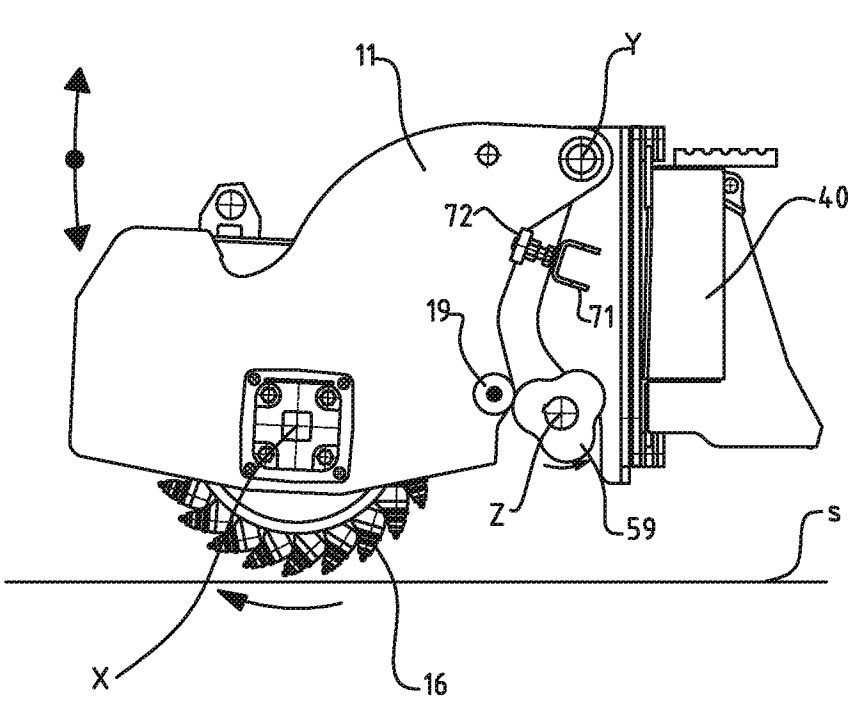
FIGS. 6*a* and 6*b* show side views of an equipment according to one embodiment of the present invention, in a second arrangement and in various machining moments, respectively.
Figure 6A:
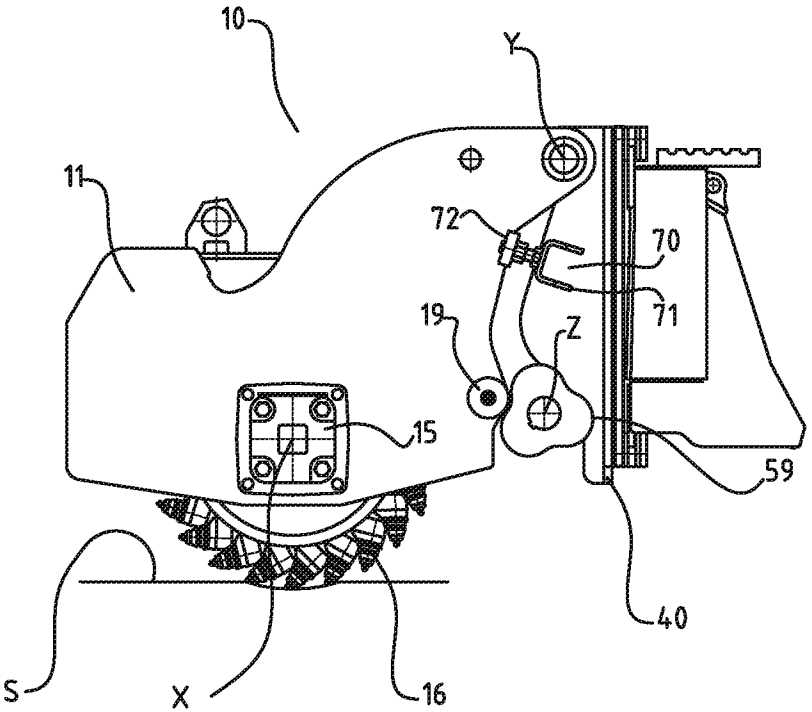

As depicted in FIGS. 1 and 2, equipment 10 according to the embodiment of the present invention therein depicted in particular comprises a main supporting frame 11 with a generic connection 40 for operatively coupling equipment 10 to the arm or movable support of a machine and/or main motor (see the following description). The main supporting frame 11 essentially is formed by two parallel plates which define an internal space for housing work means essentially consisting of a milling drum 16 equipped with teeth or digging punches 16*d* arranged on the outer peripheral surface thereof; in essentially known manner, by means of rotating the milling drum 16 in the direction of rotation indicated by the arrow in FIG. 6*b* (clockwise direction of rotation with respect to the drawings), the punches or teeth 16*d* are engaged in the layer to be milled (for example, in a solid floor made of concrete and/or asphalt and/or similar solid materials), wherein the machined material is subsequently removed. The milling drum 16 depicted in the drawings extends within the internal space delimited by the two parallel plates 11*a* and 11*b* of the main frame 11, and is rotatingly carried by a power source 15, e.g. a hydraulic motor. Motor 15 in particular extends through plate 11*a* and therefore is rigidly housed in a seat 15*a* of plate 11*a*. The end of the axle engages an end portion of a supporting element (not shown in the drawings) on the side opposite to the one of motor 15, wherein the end portion engaged by the axle is housed in a corresponding seat of plate 11*b*.

An axle 18*p* is carried by frame 11, wherein the axle 18*p* comprises two opposite end portions on each of which an adjusting arm 12 is rotatably engaged, which is alternately rotatable in the two opposite directions of rotation indicated by the double arrow in FIGS. 1 and 2. Moreover, an engagement pole or pivot 17 extends from each of the two rotatable arms 12 towards the outside of frame 11. Alternately extensible and retractable operating means are arranged between the axle 18*p* carried by the main frame 11 and the main frame 11 itself, in particular two hydraulic pistons 18 each interposed between an adjusting element or arm 12 and frame 11. Since the operating methods of the two hydraulic pistons 18 and the relative adjusting arms 12 substantially are identical, the operating methods of one of the pistons 18 and of the related adjusting arm 12 is given later. With particular reference to FIG. 2, it is apparent therefore how an extension of piston 18 (from right to left in the drawing) results in a rotation of arm 12 in anticlockwise direction with respect to the axle 18*p*, while contrarily a shortening of piston 18 (from left to right in the drawing) results in a rotation of arm 12 in clockwise direction, again with respect to the axle 18*p*. If therefore, as depicted in the drawings and indicated above, it is considered that an engagement pole or pin 17 extends outwards (on the opposite side with respect to the main frame 11) from each of the rotating adjusting elements 12 (both substantially structured like a plate), it is therefore possible to note, with particular reference to FIGS. 1 and 2, that a rotation of arm 12 in anticlockwise direction corresponds to an upwards travel of pole 17, while contrarily a rotation of arm 12 in clockwise direction results in a downwards travel of pole or pin 17.

Again with reference to FIGS. 1 and 2, it may also be noted that equipment 10 comprises a movable adjusting frame 30 which in turn comprises two parallel plates 30*a* and 30*b* which define an internal space in which the main frame 11 with the milling drum 16 and (at least partly) motor 15 are housed, wherein each of the two plates 30*a* and 30*b* comprises a support foot which defines a substantially flat support surface 33 which is rested on the surface S to be machined (milled) during the operations of equipment 10 in the arrangement depicted. In particular, plate 30*a* of the adjusting frame 30 is provided with an engagement slot 31 in which it engages the engagement pole 17 of the fixing and/or adjusting arm 12. The same can be said for plate 30*b* whereby, as depicted in particular in FIG. 2, during the rotation of the fixing and/or adjusting arms 12 in the two opposite anticlockwise and clockwise directions of rotation, each of the two engagement pins 17, in the travel thereof upwards and downwards, respectively, draws the corresponding plate 30*a* and 30*b* upwards and downwards, the adjusting frame 30 therefore being drawn upwards and alternately downwards with respect to the main supporting frame 11 between two end positions (adjusting frame 30 completely up and adjusting frame 30 completely down). Therefore, considering that, as described in detail later, during the operations of equipment 10, the rest surfaces 33 are kept resting on the surface S to be machined, the two mutual positions of the adjusting frame 30 with respect to the main supporting frame 11 correspond to the two conditions and/or configurations of maximum digging depth and minimum digging depth, respectively, wherein obviously the adjusting frame 30, with respect to the main supporting frame 11, may take on any intermediate position among the aforesaid two end positions, whereby the working depth may be any depth comprised between the maximum depth and the minimum depth described above.

From that detailed above, in particular it also is apparent that each of the fixing arms or elements 12 is structured as class 1 lever, in which in particular the resistance (formed by the adjusting frame 30) is applied to an end of the lever or arm (to pole or pin 17), the power (generated by the operating of the pistons 18) is applied to the opposite end of lever or arm 12, while the pivot of the lever (formed by the axle 18*p*) is arranged in intermediate position between the application points of the resistance and of the power, respectively.

Obviously, alternatives to the one described above fall within the scope of the present invention, in which for example the engagement slot 31 is not already made in plate 30*a* of the adjusting frame 30 but rather in arm 12, wherein here the adjustment pin or pole 17 extends from plate 30*a* of the adjusting frame 30 to engage the corresponding slot 31.

Again with reference to FIGS. 1 and 2, it may also be noted how the engagement slot 31 has an arch or semi-circle extension (essentially centered on the rotation axis of the milling drum 16), and that a further engagement pole or pin 19 extends from each of the plates 11*a* and 11*b* of the main frame 11, which engagement pole or pin engages a further slot 32 made in each of the plates 30*a* and 30*b* of frame 30, the slots 32 also having a substantially arch-shaped extension (centered on the rotation axis of drum 16). In case of the equipment according to the present invention, the adjustment of the position of the adjusting frame 30 with respect to the main supporting frame 11, and therefore the adjustment of the digging depth of the digging wheel 16, therefore is simply obtained by means of the pistons 18, in particular lengthening them (to increase the digging depth) and shortening them (to decrease the digging depth), respectively.

With reference again to FIGS. 1 and 2, it is also apparent that each of the engagement pins or poles 17 and 19 comprises a discoidal-shaped end portion to prevent the accidental disengagement of the plates 30*a* and 30*b*.

From that disclosed above, the reason why the two slots 31 and the two slots 32 are also called guide slots (in addition to engagement slots) may also be perceived.

Indeed, during the translation of the adjusting frame 30 with respect to the main supporting frame 11 (from the bottom upwards and from the top downwards with respect to the drawings) according to the methods described above (by means of the pistons 18 for setting and/or adjusting the working depth), the adjusting frame is guided during the translation thereof by the slots 31 and 32 in which there are engaged the pins or poles 17 and 19.

The methods of using and operating equipment 10 described above (in milling arrangement) may be summarized as follows.

Figure 7:
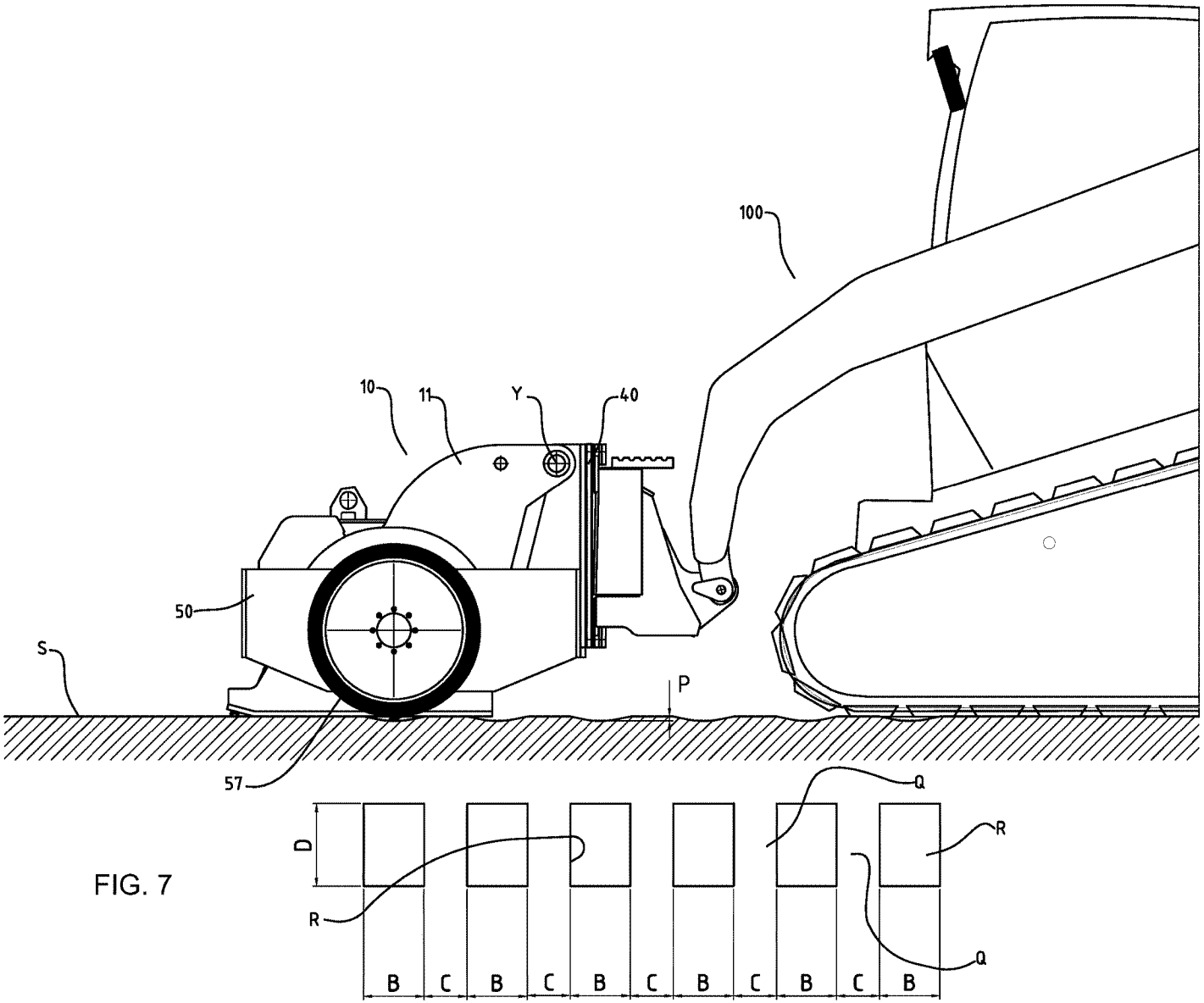
FIG. 7 shows a side view of a machine equipped with an equipment according to one embodiment of the present invention in a second arrangement.

During milling, with drum 16 rotating, apparatus 10 is caused to advance or retract (by means of machine 100, see for example FIG. 7), respectively, from right to left or from left to right with respect to the drawings; for clarity of disclosure, it is assumed later that machine 100, and therefore equipment 10, move from right to left.

In each of FIGS. 1 and 2, equipment 10 is depicted in operating position, i.e. with each of the rest surfaces 33 of the parallel plates of the adjusting frame 30 resting on the surface S to be machined. Moreover, in each of FIGS. 1 and 2, the machining or digging depth K is the same, since the extension of the pistons 18 is the same in the drawings.

Assuming however a non-ideal position of connection 40 (too high or too low due for example to an incorrect maneuver), it is apparent how a different angle, respectively, of connection 40 (and therefore of the main frame 11) with respect to the vertical would correspond with each of the different heights of connection 40 with respect to surface S, connection 40 and frame 11 being more tilted in anticlockwise direction in the case of connection 40 too high, i.e. less tilted or tilted in clockwise direction in case of connection 40 too low.

However, in the case of equipment according to the present invention, incorrect or non-ideal positions of connection 40 are compensated for due to the possibility of repositioning the adjusting frame 30 by means of the pistons 18 (according to the methods described above), wherein frame 30 is kept in the ideal condition, i.e. with the rest surfaces 33 perfectly resting on surface S. Therefore, not only is the adjusting frame 30 translatable with respect to the main frame 11 (along the slots 32*s* and 32*d*) so as to allow adjusting the working depth, but the main frame 11 and the adjusting frame 30 are released from each other in rotation, i.e. the rotation of the main frame 11 between the two stroke end positions does not result in a rotation of the adjusting frame 30, which contrarily is kept in the ideal working condition, i.e. with the rest surfaces 33 perfectly resting on the surface S to be machined.

In the following, with reference to FIGS. 3 to 6, a description is given of the second possible arrangement of the equipment according to the present invention, and the related methods of use and possible uses; in FIGS. 3 to 6, component and/or characteristic parts of the equipment according to the embodiment of the present invention therein depicted and already described above with reference to other drawings, are identified by the same reference numerals.

Figure 4A:
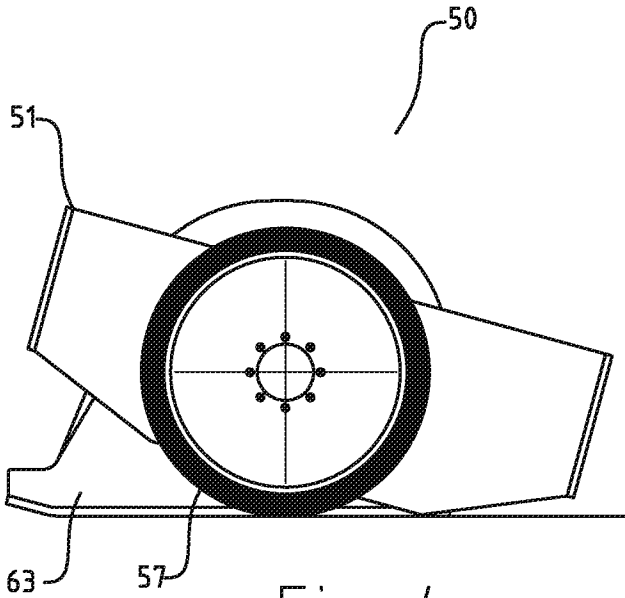
FIGS. 4*a* to 4*c* each show a side view, a partial sectional side view and a partial sectional plan view, respectively, of an adjusting carriage of the equipment according to one embodiment of the present invention.
Figure 3A:
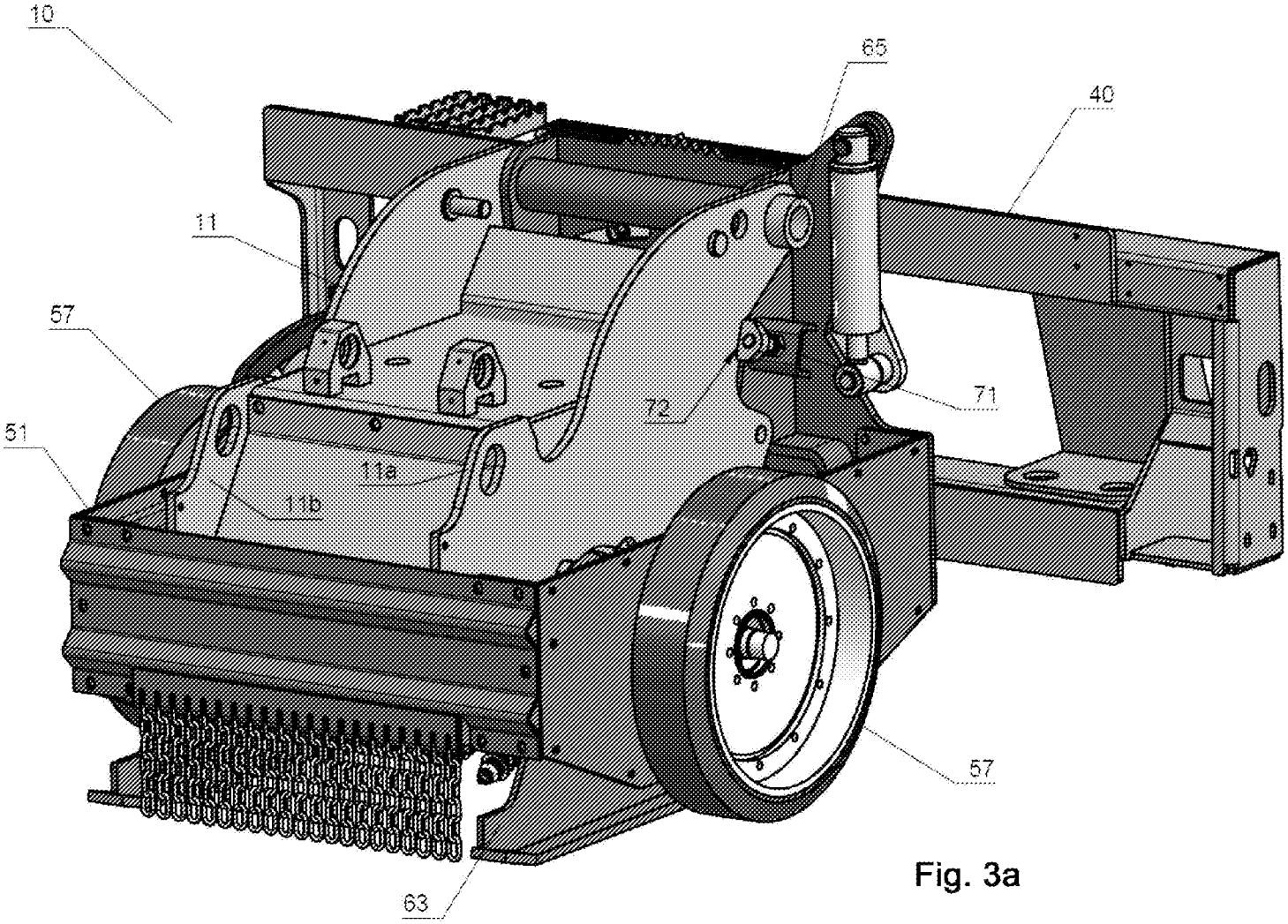
FIGS. 3*a* to 3*c* each show a perspective view of an equipment according to one embodiment of the present invention, in a second arrangement.
Figure 3B:
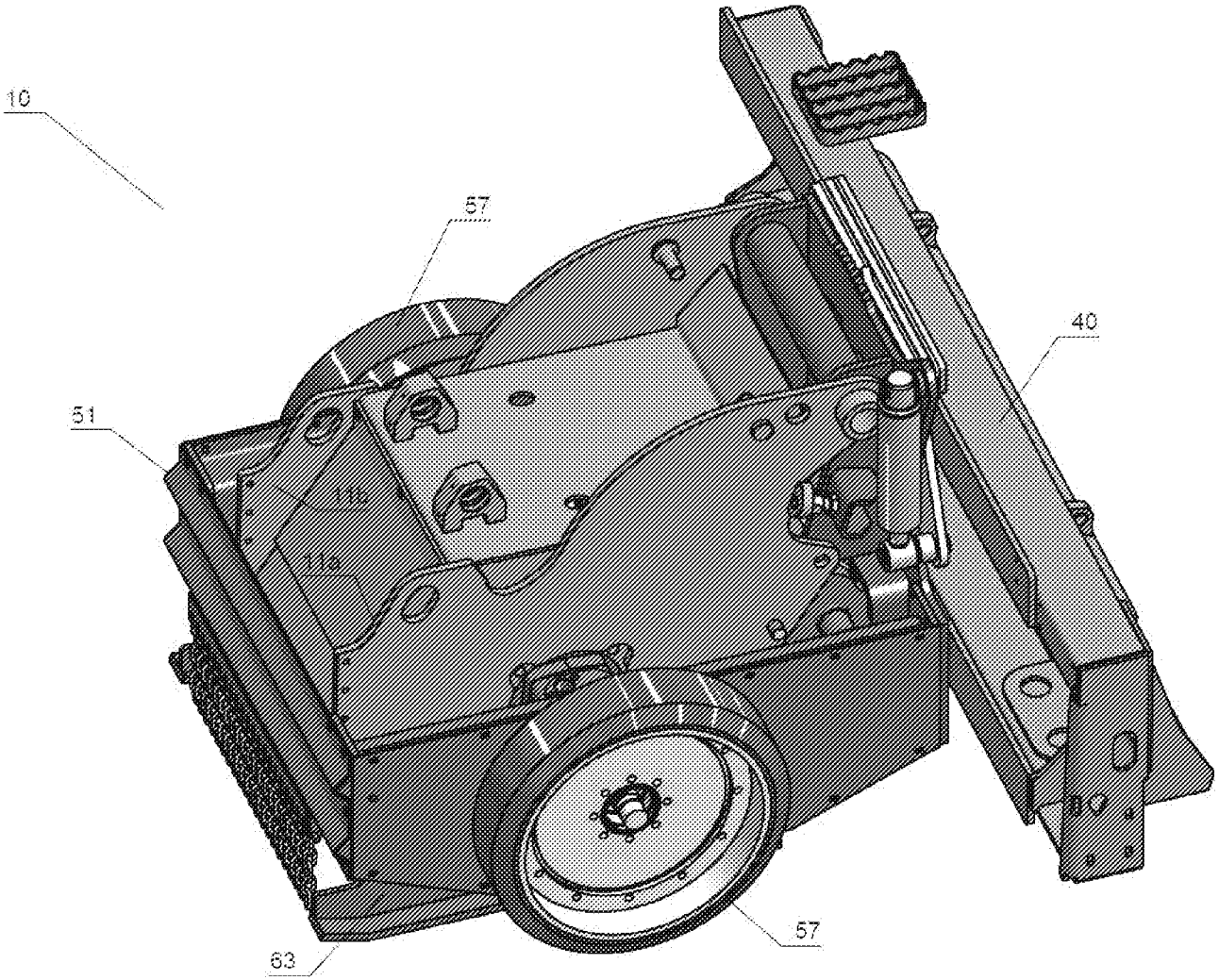
Figure 3C:
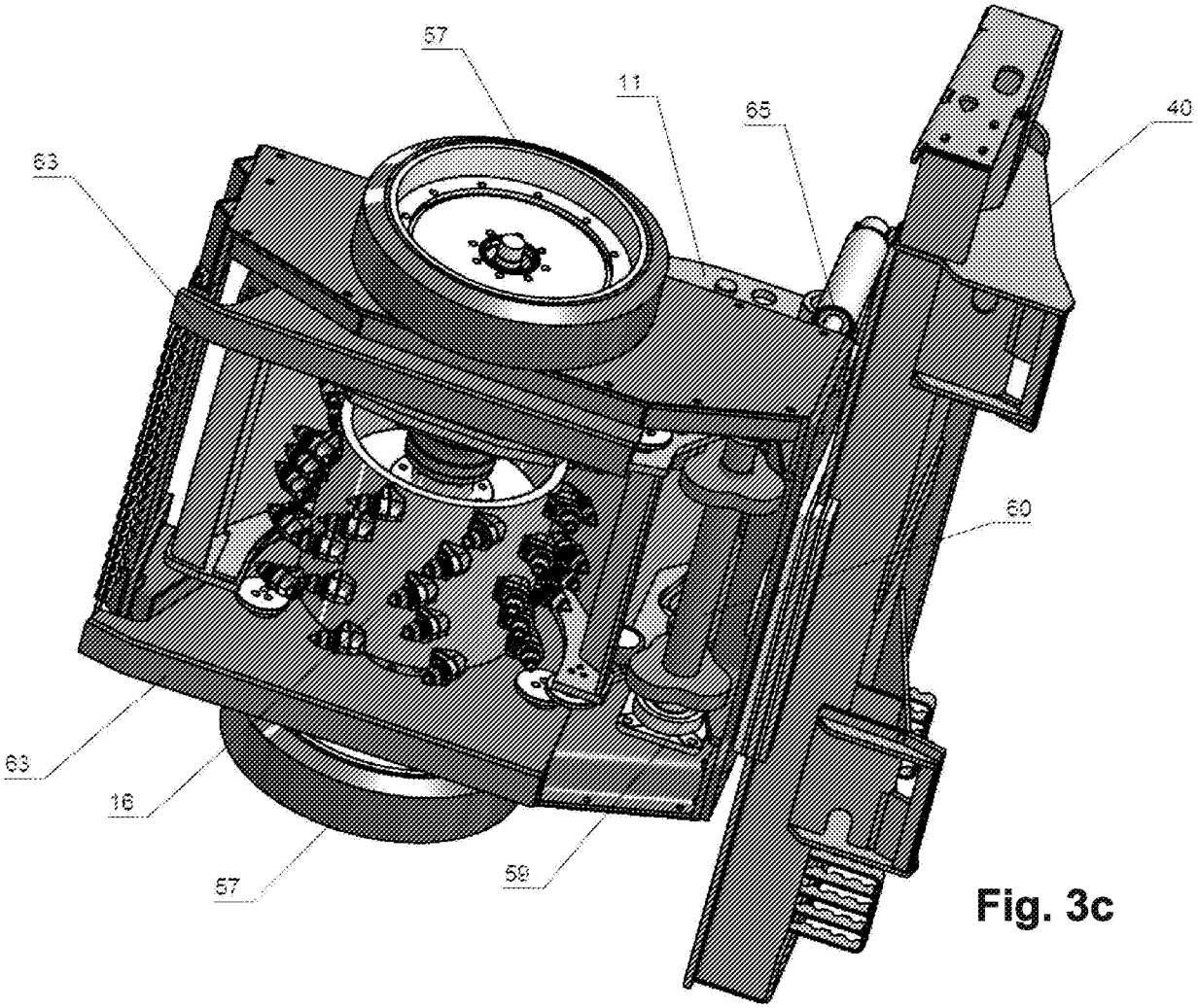
Figure 4B:
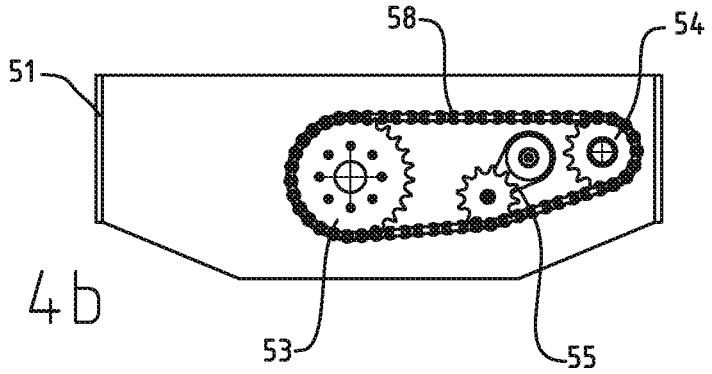

FIG. 4*a* depicts an adjusting carriage 50 adapted to be removably fixed to connection 40 by means of which, as described above, equipment 10 is applied to a main operating machine.

Figure 4C:
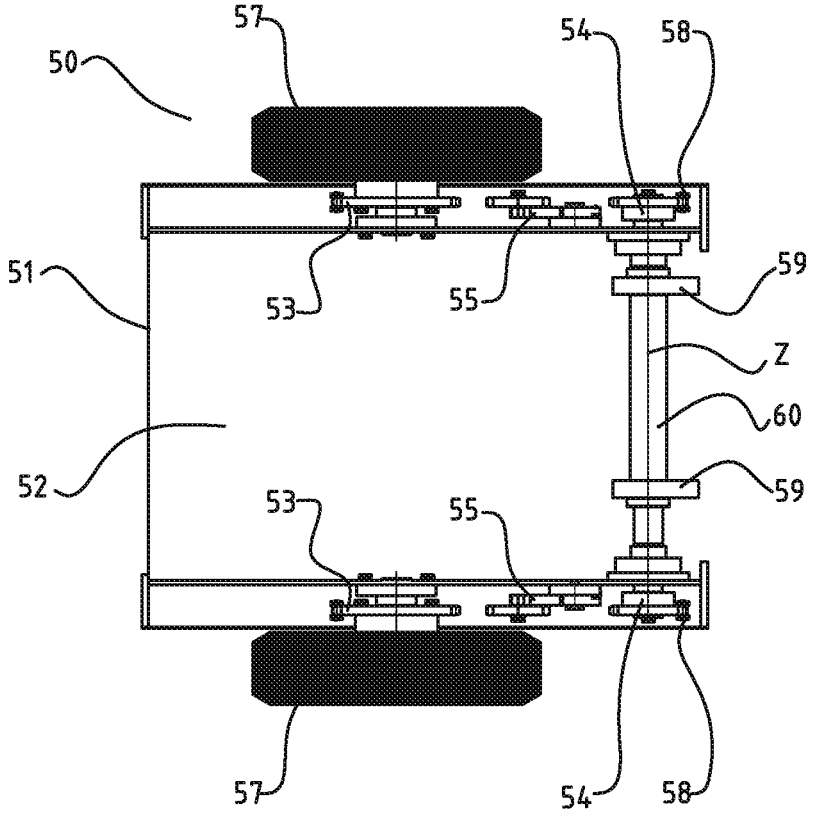

The definition of "carriage" comes in particular from the fact that, as shown for example in the plan view in FIG. 4*c*, component 50 has a similar aspect and features to the ones of a small carriage because it comprises a frame 51 (without a bottom, see the following description) which laterally defines and delimits an internal space 52 and comprises a pair of wheels 57 fixed to the carriage on opposite sides thereof with reference to the longitudinal symmetry axis of the carriage 50; the features of the two wheels and of the component parts connected therewith substantially being identical, the description is given later of only one of the two wheels 57 and of the respective component parts. Wheel 57 is idly fixed to the carriage by means of a fixing pinion, wherein therefore wheel 57 is drawn in rotation by means of the translation of carriage 50 with wheel 57 (the wheels) in contact with the ground, in particular with the surface S to be machined. A pinion 53 (ring gear) is rigidly applied on the hub of wheel 57. There is engaged, on the ring gear 53, a driving chain 58 which also engages, on the opposite side with respect to the ring gear 53, a second ring gear 54 rigidly fixed at the end of an axle 60 rotatably carried by the frame 51 of carriage 50. There are also provided adjustment means 55 (practically e.g. a chain tensioner) between the two ring gears 53 and 54 for adjusting the tension of chain 58. It is therefore apparent that the drawing in rotation of the wheels 57 by means of translating carriage 50 with the wheels 57 in contact with the ground (with surface S) results in the drawing in rotation of the axle about a rotation axis Z. Two cams 59 also are removably fixed (e.g. keyed) onto axle 60, wherein therefore the rotation of axle 60 results in the rotation, in the same direction of rotation, of the cams 59.

There is also fixed, on the hub of all wheels 57, a protective strap 63, which is free to rotate with respect to the frame 51 of carriage 50.

Figure 5B:
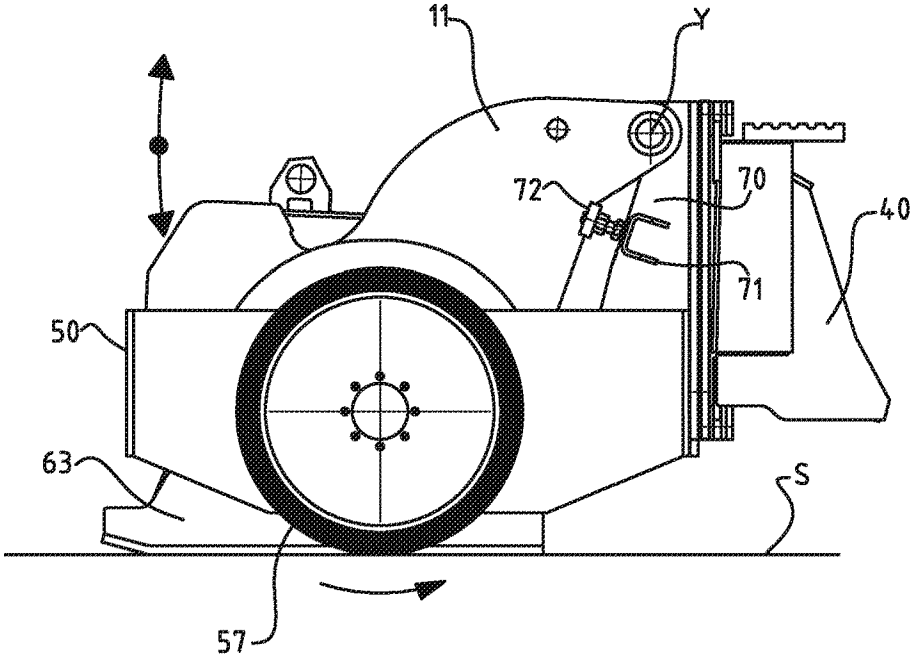
FIGS. 5*a* and 5*b* show side views of an equipment according to one embodiment of the present invention, in a second arrangement and in various machining or working moments, respectively.
Figure 5A:
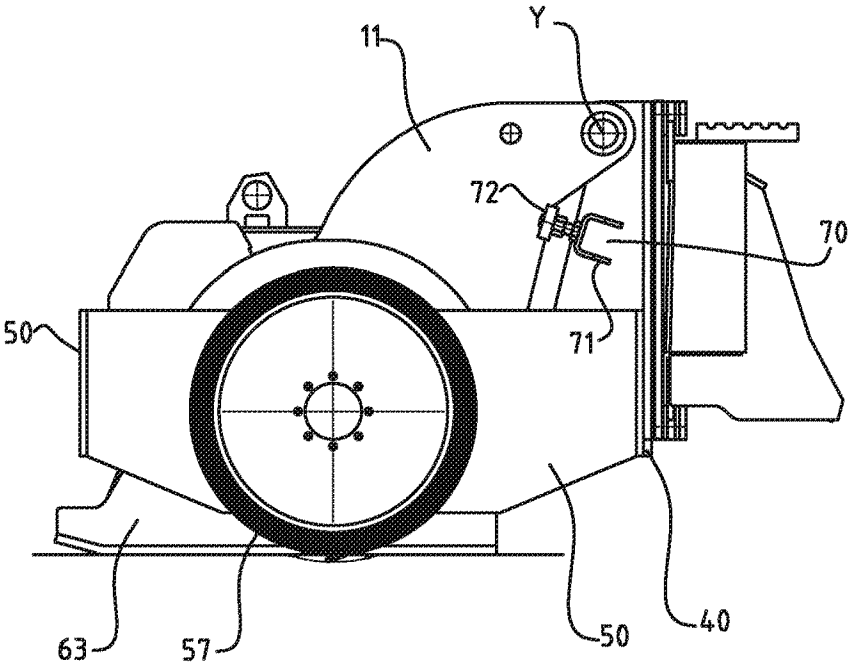

FIGS. 5*a* and 5*b* show carriage 50 applied to connection 40, in particular at a side wall fixed to connection 40 by means of means adapted to allow the removal of carriage 50, such as for example bolts and respective nuts, screws and/or similar means. In particular, it is apparent from FIGS. 5*a* and 5*b* that carriage 50 is sized in such a manner whereby space 52 defined and delimited by frame 51 is such as to at least partly house the main frame 11 of equipment 10 with the related lively drum 16, motor 15 and any further component parts carried by the main frame 11. In the embodiment depicted, the fixing of carriage 50 to connection 40 provides removing the adjusting frame 30, in particular at least the side straps 30*a* and 30*b* and possibly the engagement poles or pins 17 and 19 and/or the pistons 18, arms 12 and the related axle 18*p*. The application of carriage 50 may therefore simply occur by means of raising apparatus 10 (by means of machine) and then lowering apparatus 10 with positioning of the main frame 11 and of the component parts carried thereby in space 52 delimited by the frame 51 of carriage 50, and finally by means of fixing carriage 50 to connection 40 according to the methods described previously, wherein removing carriage 50 obviously may occur by releasing carriage 50 from connection 40 and simply raising apparatus or equipment 10.

It is also to be noted how the main frame 11 is rotatably restrained to connection 40, for example by means of a further axle 65, the main frame 11 therefore being rotatable with respect to connection 40 about a rotation axis Y. It is apparent from drawings 6*a* and 6*b*, in which the frame 51 of carriage 50 is not depicted for reasons of clarity, that each of the two cams 59 engages a corresponding portion of the main frame 11, for example a pin or hub 19 (if not removed), or alternately a further pin or hub applied for the purpose to the main frame 11. Each of the two cams 59 consists of a plate element delimited by two opposite main surfaces, mutually joined by a peripheral cam surface. The engagement of the peripheral surface of each cam 59 with the corresponding portion of frame 51, for example with the pin or pole or hub 19, with axle 60 and therefore with the cams 59 in rotation as indicated by the arrow in FIG. 6*b*, obviously results in a rotation of the main supporting frame 11 (and of drum 16) alternately in the two directions of rotation indicated by the double arrow in FIG. 6*b*, and therefore alternately moving away from (FIG. 6*b*) and moving close to (FIG. 6*a*) surface S.

In the embodiment depicted in the drawings, each cam 59 comprises three lobes (with maximum radius) and three depressions or notches (with minimum radius), therefore wherein each complete rotation (equal to 360°) of the cams 59 results in just as many oscillations of the main frame 11 and of drum or rotor 16, i.e. in three rotations in clockwise direction (moving away from surface S) and in three rotations in opposite anticlockwise direction and moving close to surface S. Obviously, n oscillations of frame 11 and of drum 16 are obtained with cams 59 with n lobes.

The methods of use and functionalities of equipment 10 in the second arrangement described above are described later with reference to FIG. 7. With reference to the drawing and considering that indicated above, it is apparent how the advancing of machine 100 (but alternately also the retraction thereof) results in the drawing in rotation of the wheels 57 of carriage 50, and therefore the drawing in rotation of the cams 59, and also in oscillations of the main frame 11 and of drum 16 (rotations alternately in opposite directions of rotation), and therefore in the alternate engagement and disengagement of surface S by drum 16, and therefore in the creation (milling or scarifying), with drum 16 in rotation, in surface S of depressions R having width D (equal to the longitudinal extension of drum 16) and depth P alternated with portions of surfaces left intact or milled or scarified at a depth which is less than depth P. Obviously, the distance between two successive portions R depends in a proportionately inverse manner on the number of lobes of the cams 59 and is completely independent of the advancement (or retraction) speed of machine 100, and therefore of apparatus 10.

Concerning depth P of the depressions R (sound strips), it is worth noting how the equipment comprises means 70 for adjusting the stroke end position of frame 11, and therefore of the rotor or drum 16 advancing towards surface S. In the embodiment depicted, said means 70 for adjusting the stroke end position in particular comprise a contact element 71 fixed to connection 40 and a respective contact element 72 fixed to the main frame 11 with adjustable extension and length, therefore wherein element 72 abuts against element 71 during downwards rotation of frame 11, and therefore wherein deeper depressions or sound strips R may be obtained by shortening the contact element 72, while contrarily the depth of the depressions R increases by lengthening the contact element 72.

It has therefore been shown by the detailed description above of the embodiments of the present invention depicted in the drawings, that the present invention allows the preset objects to be reached and/or overcome, or at least the drawbacks typical of the solutions according to the known art, to be minimized.

In particular, according to the present invention, a normal milling machine may be readapted as apparatus for making sound strips and readapted again as a normal milling machine by means of simple, immediate and therefore affordable operations. Moreover, the apparatus according to the present invention is characterized in that it has limited volumes and weights and therefore is suitable for being operated by means of different machines, they also characterized by limited volumes and contained costs, in particular management costs. Moreover, in a first arrangement, the apparatus or equipment according to the present invention allows the simple and reliable adjustment of the working depth, while in a second arrangement, it allows adjusting the depth and the distance of the sound strips in just as simple and reliable a manner.

Although the present invention was clarified by means of a detailed description of the embodiments thereof depicted in the drawings, the present invention obviously is not limited to the embodiments described above and depicted in the drawings; contrarily, all those variants of the embodiments described and depicted, which are clear, obvious and apparent to persons skilled in the art, fall within the scope of the present invention. For example, according to an alternative embodiment, transmission 58 may be replaced by a belt transmission, cardan transmission, or in any case transmission of known type. Moreover, kits of ring gears 53 and/or 54 may be provided with a different number of teeth and/or different diameter in order to vary, according to needs and/or circumstances, the ratio between the revolutions of the wheels 57 and the ones of the cams 59, wherein the number of oscillations may be varied simply using wheels 57 having different diameter. Moreover, one transmission alone may be provided between a wheel 57 and axle 60, or also one cam 59 alone may be provided on axle 60. Moreover, a kit of interchangeable cams 59 with a different number of lobes may be provided.

Again, one hydraulic piston 18 alone may be provided, acting on a single corresponding arm 12, wherein the piston may possibly be replaced by a manually-adjustable jack. The object of the present invention is therefore defined by the claims.

The invention claimed is:

1. A kit for machining a surface made of solid materials, the kit comprising:

an equipment for machining said surface made of solid materials comprising:

a coupling means for mechanically coupling said equipment to a main operating machine;

a main supporting frame; and a rotatable machining or milling means carried by said main supporting frame, wherein said rotatable machining or milling means is suitable to be rotated about a first predefined rotation axis and the main supporting frame is fixed to said coupling means such that the main supporting frame is rotatable about a second rotation axis, the second rotation axis being substantially parallel to said first rotation axis, wherein said equipment is inter-connectable with an adjusting carriage and with an adjusting frame, and the equipment being selectively interconnected with the adjusting carriage or with the adjusting frame;

wherein the adjusting carriage is for adjusting a working depth of said machining or milling means, wherein said adjusting carriage comprises rotating means that engage said main supporting frame, wherein a rotation of said rotating means in a predefined direction of rotation results in said main supporting frame being rotated about said second rotation axis alternately in two opposite directions with respect to both said coupling means and said adjusting carriage, wherein said adjusting carriage is removably fixable to said coupling means, wherein the adjusting frame defines at least one substantially flat contact portion adapted to be arranged in contact with a corresponding portion of the surface to be machined, wherein a position of the adjusting frame is adjustable via an adjusting means that is adapted to allow adjusting the position of said adjusting frame with respect to said main supporting frame so as to allow adjusting the working depth of said machining or milling means, wherein said adjusting frame and said adjusting means are removably fixable to said main supporting frame.

2. The kit according to claim 1, wherein said adjusting means comprise a first fixing arm or lever suitable to be rotated with respect to said main supporting frame and by means of which said adjusting frame is fixed to said main supporting frame, so that rotating said fixing arm or lever about said main supporting frame in two opposite directions of rotation results in said adjusting frame being rotated with respect to said main supporting frame respectively in two opposite directions of translation.

3. The kit according to claim 2, wherein said fixing arm or lever is structured as a class 1 lever, wherein said adjusting frame is rotatably fixed to a first end portion of said fixing arm or lever that comprises the point of application of the resistance of said class 1 lever.

4. The kit according to claim 2, wherein said adjusting means comprise operating means alternately extensible and retractable applied to a second end portion of said fixing arm or lever so that the extension of said operating means results in said fixing arm or lever being rotated in one direction of rotation while the retraction of said operating means results in said fixing arm or lever being rotated in the opposite direction of rotation with respect to said one direction of rotation.

5. The kit of claim 1, wherein the adjusting carriage and the adjusting frame are interchangeably fixed to said equipment.

6. The kit according to claim 1, wherein said rotating means of said adjusting carriage comprise at least one cam element that defines a cam surface by means of which the at least one cam element engages said main supporting frame.

7. The kit according to claim 6, wherein said at least one cam element comprises a predefined number n of lobes, so that a complete rotation of the at least one cam element translates into n rotations of said main supporting frame about said second rotation axis in the same direction of rotation of said at least one cam element.

8. The kit according to claim 7, wherein said at least one cam element is rotatable about a third rotation axis substantially parallel to said first and second rotation axes.

9. The kit according to claim 8, wherein said adjusting carriage comprises a supporting structure structured so as to define an internal space in which said main supporting frame is at least partially housed.

10. The kit according to claim 1, wherein, said adjusting carriage comprises drawing means for drawing in rotation said rotating means.

11. The kit according to claim 10, wherein said drawing means comprise at least one wheel suitable to be rotated through contact with the solid surface to be machined, and in that said adjusting carriage comprises transmission means for transmitting a rotating motion from said at least one wheel to said rotating means.

12. The kit according to claim 11, wherein said transmission means comprises a chain.

13. The kit according to claim 1, wherein the solid materials consist at least one of an asphalt material and a concrete material.

14. A method for using the kit of claim 1, to make rumble strips and for normal milling operations, wherein, for making the rumble strips, said adjusting carriage is removably fixed to said coupling means of said equipment, and said adjusting frame and said adjusting means are removed from the main supporting frame of said equipment and for the normal milling operations, said adjusting carriage is removed from said equipment, and said adjusting frame and said adjusting means are removably fixed to said supporting frame of said equipment.

15. The method of claim 14, wherein said adjusting means comprise a first fixing arm or lever suitable to be rotated with respect to said main supporting frame and by means of which said adjusting frame is fixed to said main supporting frame, so that rotating said fixing arm or lever about said main supporting frame in two opposite directions of rotation results in said adjusting frame being rotated with respect to said main supporting frame respectively in two opposite directions of translation.

* * * * *